United States Patent [19]

Thommen et al.

[11] Patent Number: 4,881,912

[45] Date of Patent: Nov. 21, 1989

[54] HIGH VOLTAGE COAXIAL CONNECTOR

[75] Inventors: Robert L. Thommen, Indianapolis; Eric B. Parker, Greenwood, both of Ind.

[73] Assignee: Specialty Connector Company, Inc., Franklin, Ind.

[21] Appl. No.: 188,035

[22] Filed: Apr. 29, 1988

[51] Int. Cl.[4] ..... H01R 17/18

[52] U.S. Cl. ..... 439/585; 439/582

[58] Field of Search ..... 439/578–585, 439/675, 92, 98, 99

[56] References Cited

U.S. PATENT DOCUMENTS

| | | | |
|---|---|---|---|
| 2,742,625 | 4/1956 | Bird et al. | 439/582 |
| 2,754,487 | 7/1956 | Carr et al. | 439/578 |
| 2,995,388 | 8/1961 | Morello et al. . | |
| 3,432,798 | 3/1969 | Brishka . | |
| 3,513,425 | 5/1970 | Arndt . | |
| 3,528,052 | 9/1970 | Brishka . | |
| 3,675,181 | 7/1972 | Lankford et al. | 439/581 |
| 3,701,086 | 10/1972 | Somerset . | |
| 3,836,946 | 9/1974 | Geiger . | |
| 4,025,150 | 5/1977 | Nordberg et al. | 439/583 |
| 4,131,332 | 12/1978 | Hogendobler et al. | 439/585 |
| 4,655,534 | 4/1987 | Stursa | 439/582 |

FOREIGN PATENT DOCUMENTS 1177220 1/1970 United Kingdom .

*Primary Examiner*—David Pirlot

*Attorney, Agent, or Firm*—Woodard, Emhardt, Naughton, Moriarty & McNett

[57] ABSTRACT

A coaxial connector for mating a coaxial cable to a mating connector includes a hollow interior within the connector and insulation lining the hollow interior. Insulation lines the tubular passage through which the coaxial cable inner dielectric and center conductor are inserted into the hollow interior of the connector during field attachment of the connector to the cable. A tapered opening in the insulator lining the hollow interior is sized to receive and guide the inner dielectric of the coaxial cable being attached. There is also provided an access hole into the hollow interior to facilitate connection of the inner conductor of the coaxial cable to the center conductor pin of the connector. The access hole is closed by an insulation piece sized for insertion into the access hole.

8 Claims, 2 Drawing Sheets

HIGH VOLTAGE COAXIAL CONNECTOR

BACKGROUND OF THE INVENTION

This invention relates to an electrical connector for a coaxial cable.

The object of coaxial cable connector design is to facilitate electrical connections and maintain impedance and standing wave ratio parameters within certain acceptable limits. Coaxial connectors currently available on the market are typically rated at 500–1,000 volts maximum, and the subminiature series coaxial connectors are typically rated at no more than 350–500 volts. Ordinarily, high voltage capacity is not a consideration in the design of a subminiature coaxial connectors.

In one case, coaxial cables and coaxial connectors are used to interconnect heart monitoring sensors and electrocardiogram (EKG) equipment during open-heart surgery. If during the operation the patient's heart stops, a voltage of 3,600 volts is applied to the heat to shock the heart back into operation.

Currently available connectors require close attention to assembly in order to prevent arcing when subjected to a 3,600 volt or higher signal. The typical procedure required to attach a subminiature coaxial connector to a coaxial cable which will carry a high voltage signal involves soldering the center conductor to a contact pin, cleansing the solder joint with freon to remove impurities, and sealing the solder joint in silicon rubber compound to prevent arcing between the center conductor and the surrounding connector body.

Certain electrocardiogram machines are designed to only accept subminiature coaxial connectors which are called the SMB design series. These EKG machine connectors must be smaller than five sixteenths of an inch across on the outer body and able to withstand a 4,000 volt potential which is typically able to jump a three sixteenths of an inch air gap.

SUMMARY OF THE INVENTION

It is an object of this invention to provide an electrical connector for a coaxial cable which can withstand a high-voltage signal and prevent arcing from the center conductor to ground.

A coaxial cable connector according to one aspect of the invention includes a conductive body having a hollow interior and a tubular portion communicating with the hollow interior. The body also has an access opening extending into the hollow interior. Insulation lines the hollow interior of the conductive body with the insulation extending outwards within the tubular portion of the connector body. The connector also includes a mating coaxial connector attached to the body of the connector, allowing the coaxial cable to mate with a variety of coaxial connector receptacles. The interior hollow of the connector is sealed from the outside by an insulation piece inserted into the access opening of the connector body. The connector further includes clamping means for securing the coaxial cable to the tubular portion of the connector body and electrically connecting the shield of the coaxial cable to the conductive body.

A general object of the invention is to provide an improved coaxial connector.

Another object is to provide a connector capable of withstanding a high voltage signal.

A further object is to provide a low cost field serviceable and replaceable connector capable of withstanding a highvoltage signal.

These and other objects and advantages of the present invention will become more apparent upon reference to the following detailed description and accompanying drawings.

DESCRIPTION OF THE PREFERRED EMBODIMENT

Figure 1:
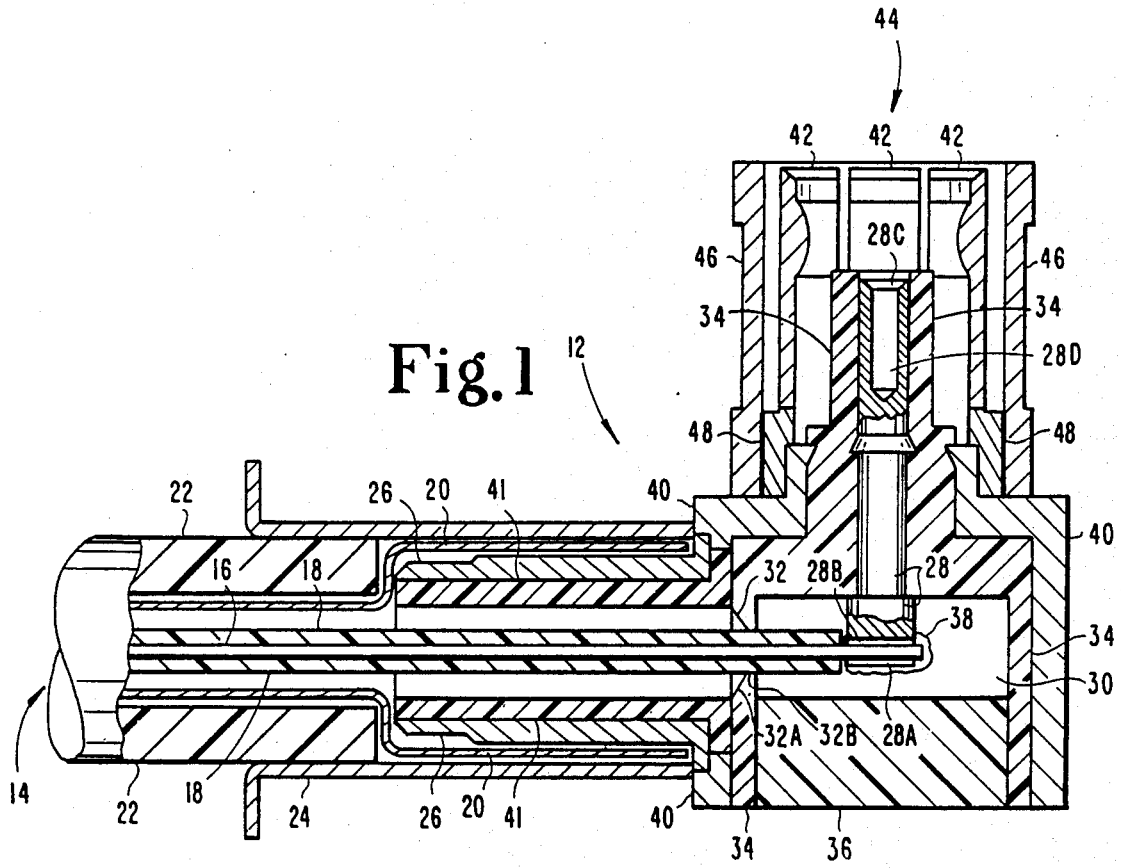
FIG. 1 is a sectional drawing of the connector of the present invention showing a coaxial cable permanently attached thereto as is accomplished in field installation.

For the purposes of promoting an understanding of the principles of the invention, reference will now be made to the embodiment illustrated in the drawings and specific language will be used to describe the same. It will nevertheless be understood that no limitation of the scope of the invention is thereby intended such alterations and further modifications in the illustrated device, and such further applications of the principles of the invention as illustrated therein being contemplated as would normally occur to one skilled in the art to which the invention relates.

Figure 2:
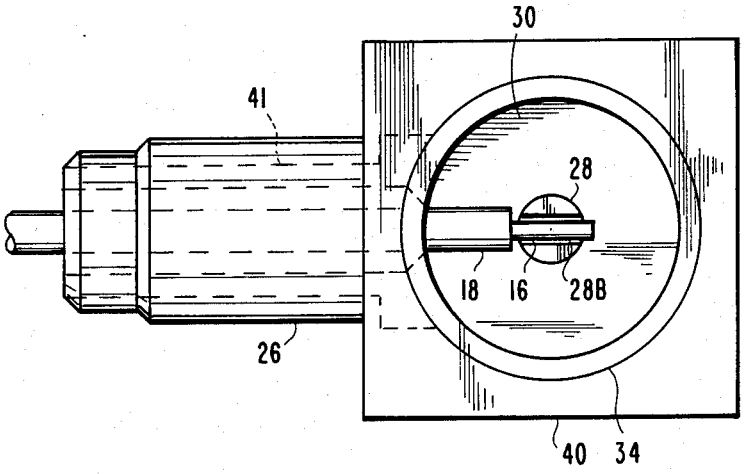
FIG. 2 is a bottom plan view of the structure illustrated in FIG. 1 with an insulation piece forming a part of the structure removed to show internal construction.

A coaxial connector 12 is shown attached to a coaxial cable 14 in FIG. 1 as in a typical field installation. The coaxial cable 14 consists of a center conductor 16, a dielectricl 18, an outer conductor or shield 20, and an outer insulator 22. Typical of such cables are those conforming to industry standard RG-174 specifications. The tubular member 26 is welded to connector body 40 to form a single piece assembly. Referring to FIG. 2, connector body 40 is dimensionally five-sixteenths inch square from this view. That is, each side has a dimension of 5/16 inch. The body 40 and tubular member 26 are preferably made of brass and plated with nickel.

Referring to FIG. 1, coaxial cable 14 is mechanically secured to the tubular member 26 of connector body 40 by way of clamping sleeve 24 which clamps the outer conductor 20 to the tubular member 26. The clamping sleeve 24 maintains electrical contact between the tubular member 26 and the outer conductor 20 of the coaxial cable 14. Clamping sleeve 24 is preferably made of brass.

As shown in FIG. 1, dielectric 18 and center conductor 16 both extend through the tapered opeing 32 of interior insulator 34 into the hollow interior 30 wherein center conductor 16 is attached to a first end 28A of conductor pin 28 with solder 38. Center conductor pin 28 is rigidly fixed in interior insulator 34 so that conductor pin 28 is electrically isolated from the surrounding conductive connector body 40 and the shield contact snap connection fingers 42 of coaxial mating connector 44. The tapered opeing 32 in interior insulator 34 is sized to snugly fit the dielectric 18 and has a tapered portion 32A and a cylindrical portion 32B. Referring to FIG. 2, conductor pin 28 is shown having a rectangular groove 28B in the end 28A. The dielectric 18 and center conductor 16 of coaxial cable 14 are shown inserted through the tubular insulator 41 and the tapered opening 32 of interior insulator 34 into the hollow interior 30. Conductor pin 28 receives center conductor 16 in the rectangular groove 28B in the end of conductor pin 28. Referring to FIG. 1, the second end 28C of conductor pin 28 is a part of coaxial mating connector 44.

Referring now to FIG. 1, insulation piece 36 is shown inserted into the access opening of the hollow interior 30. After insulation piece 36 is inserted, the hollow interior 30 surrounding the solder connection between center conductor 16 and conductor pin 28 is defined by interior insulator 34 and insulation piece 36. Tubular insulator 41 lines the interior of tubular member 26 and is engaged with interior insulator 34 thereby totally encapsulating the hollow interior 30 and the passage into the hollow interior with electrical insulation. Tubular insulator 41, insulation piece 36, and interior insulator 34 are made of Teflon or other suitable insulating materials.

Referring now to FIG. 1, coaxial mating connector 44 includes snap connector fingers 42, an outer sleeve 46, a portion of interior insulator 34, and the second end of conductor pin 28. The outer sleeve 46 and snap connector fingers 42 are attached to connector body 40 by solder 48. The outer sleeve 46 is made of nickel plated brass or similar material. The snap connector fingers 42 are made of brass or beryllium copper or material of similar electrical and mechanical properties. The end 28C of conductor pin 28 has a cylindrical void 28D designed to accept a mating pin. The conductor pin 28 is gold plated copper or other similar materia.

Interior insulator 34 extends within connector body 40 toward and within the coaxial mating connector 44. Insulator 34 is formed within the mating connector 44 to conform to the particular style of coaxial mating connector used. As shown in FIG. 1, the insulator 34 is formed to mate with a male connector of the industrial design standard known as the SMB series. Any of numerous varieties of coaxial mating connectors, including push-on, screw-on, or snap-on mating connectors, may be substituted for the SMB style coaxial mating connector 44 depicted in FIG. 1.

The high voltage coaxial connector described herein is not limited to any particular angular orientation between the cable receiving end of the connector 12 and the coaxial mating connector 44 end of the connector 12.

As suggested above, the connector 12 is designed to facilitate easy permanent attachment of the cable 14 to the connector 12 in the field. The outer insulator 22 is stripped from the end of cable 14 and the braid shield is compressed longitudinally to compress it and enlarge it so that it fits over the tubular member 26. The dielectric 18 is stripped from the end 28A of the center conductor 16 so as to expose the end approximately ⅛ inch. The center conductor and dielectric 18 are guided through the insulator 34 by the tapered surface 32A to a position wherein the cylindrical portion 32B cradles and receives the dielectric 18 and the center conductor 16 is received in the rectangular groove 28B. The conductor 16 is then soldered to the pin 28 and field installation is completed by insertion of the insulation piece 36.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A coaxial cable connector comprising:

a conductive body having a hollow and a tubular portion communicating with the hollow interior, said body also having an access opening extending into the hollow interior;

insulation means completely lining the hollow interior of said conductive body, said insulation means having an opening therein coaxial with the tubular portion of said conductive body;

a coaxial mating connector attached to said conductive body and including a shield contact connected to said conductive body, said coaxial mating connector also including a coaxial insulator which is an extension of said insulation means, said coaxial mating connector further including a conductor pin one end of which acts as a contact for said coaxial connector and the other end of which extends into said hollow interior, said pin being fixed within said coaxial insulator and insulation means;

an insulating piece for insertion into said access opening; and clamping means for securing a coaxial cable to the tubular portion of said conductive body and electrically connecting the shield of the coaxial cable to said conductive body, such that the center conductor of the coaxial cable extends into said hollow interior in contact with said conductor pin, whereby the contact between said conductor pin and the center conductor of the coaxial cable is accessible through said access opening before said insulating piece is inserted into said access opening.

2. The coaxial connector as described in claim 1 wherein:

said insulation means extends outwardly within the tubular portion of said conductive body defining a cylindrical passage.

3. The coaxial connector as described in claim 2 wherein:

said insulation means includes an inwardly tapered portion, said taper being coaxial with said cylindrical passage and leading into said hollow interior.

4. The coaxial connector as described in claim 3 wherein said taper of said insulation means at its smallest diameter is adapted to contiguously contact the inner insulator of the coaxial cable inserted into the tubular portion of said conductive body.

5. A coaxial cable connector comprising:

a conductive body having a hollow interior and a tubular portion communicating with the hollow interior, said body also having an access opening extending into the hollow interior;

insulation means lining the hollow interior of said conductive body, said insulation means having an opening therein coaxial with the tubular portion of said conductive body;

a coaxial mating connector attached to said conductive body and inclusing a shield contact connected to said conductive body, said coaxial mating connector also including a coaxial insulator which is an extension of said insulation means, said coaxial mating connector further including a conductor pin one end of which acts as a contact for said coaxial connector and the other end of which extends into said hollow interior, said pin being fixed within said coaxial insulator and insulation means;

an insulating piece for insertion into said access opening;

clamping means for securing a coaxial cable to the tubular portion of said conductive body and electrically connecting the shield of the coaxial cable to said conductive body; wherein said insulation means extend outwardly within the tubular portion of said conductive body defining a cylindrical passage;

said insulation means includes an inwardly tapered portion, said taper being coaxial with said cylindrical passage and leading into said hollow interior;

said taper of said insulation means at its smallest diameter is adapted to contiguously contact the inner insulator of the coaxial cable inserted into the tubular portion of said conductive body; and said insulation means comprises a tubular insulator fixed within the tubular portion of said conductive body and an insulator lining the hollow interior of said conductive body, said tubular insulator abutting said insulator lining the hollow of said body.

6. The coaxial cable connector as described in claim 5 wherein:

said insulation piece is cylindrical in shape and said access opening into said conductive body has a cylindrical configuration adapted to fit said insulation piece.

7. A coaxial cable connector comprising:

a conductive body having a hollow interior and a tubular portion communicating with the hollow interior, said body also having an access opening extending into the hollow interior;

insulation means lining the hollow interior of said conductive body, said insulation means having an opening therein coaxial with the tubular portion of said conductive body;

a coaxial mating connector attached to said conductive body and including a shield contact connected to said conductive body, said coaxial mating connector also including a coaxial insulator which is an extension of said insulation means, said coaxial mating connector further including a conductor pin one end of which acts as a contact for said coaxial connector and the other end of which extends into said hollow interior, said pin being fixed within said coaxial insulator and insulation means;

an insulating piece for insertion into said access opening;

clamping means for securing a coaxial cable to the tubular portion of said conductive body and electrically connecting the shield of the coaxial cable to said conductive body; wherein said insulation means extends outwardly within the tubular portion of said conductive body defining a cylindrical passage; and said insulation means includes a tubular insulator fixed within the tubular portion of said conductive body and an insulator lining the hollow interior of said conductive body said tubular insulator abutting said insulator lining the hollow of said body.

8. A coaxial cable connector comprising:

a conductive body having a hollow interior and a tubular portion communicating with the hollow interior, said body also having an access opening extending into the hollow interior;

insulation means completely lining the hollow interior of said conductive body, said insulation means having an opening therein coaxial with the tubular portion of said conductive body;

a coaxial mating connector attached to said conductive body and including a shield contact connected to said conductive body, said coaxial mating connector also including a coaxial insulator which is an extension of said insulation means, said coaxial mating connector further including a conductor pin one end of which acts as a contact for said coaxial connector and the other end of which extends into said hollow interior, said pin being fixed within said coaxial insulator and insulation means;

an insulating piece for insertion into said access opening; and means for receiving a coaxial cable such that the center conductor of the coaxial cable extends into said hollow interior in contact with said conductor pin, whereby the contact between said conductor pin and the center conductor of the coaxial cable is accessible through said access opening before said insulating piece is inserted into said access opening.

* * * * *

UNITED STATES PATENT AND TRADEMARK OFFICE

CERTIFICATE OF CORRECTION

PATENT NO. : 4,881,912

DATED : November 21, 1989

INVENTOR(S) : Robert L. Thommen, et al.

It is certified that error appears in the above-identified patent and that said Letters Patent is hereby corrected as shown below:

In column 1, line 21, please delete the word "heat" and insert in lieu thereo the word --heart--.

In column 2, line 3, please delete the word "highvoltage" and insert in lieu thereof the word --high-voltage--.

In column 2, line 24, please delete the word "intended" and insert in lieu thereof the word --intended,--.

In column 2, line 33, please delete the word "dielectricl" and insert in lieu thereof the word --dielectric--.

In column 2, line 51, please delete the word "opeing" and insert in lieu thereof the word --opening--.

In column 2, line 59, please delete the word "opeing" and insert in lieu thereof the word --opening--.

In column 3, line 27, please delete the word "materia" and insert in lieu thereof the word --material--.

UNITED STATES PATENT AND TRADEMARK OFFICE

CERTIFICATE OF CORRECTION

PATENT NO. : 4,881,912

DATED : November 21, 1989

INVENTOR(S) : Robert L. Thommen, et al.

It is certified that error appears in the above-identified patent and that said Letters Patent is hereby corrected as shown below:

In column 4, line 1, between the words "hollow" and "and" insert the word --interior--.

In column 4, line 58, please delete the word "inclusing" and insert in lieu thereof the word --including--.

In column 5, line 5, please delete the word "extend" and insert in lieu thereof the word --extends--.

Signed and Sealed this

Thirtieth Day of October, 1990

*Attest:*

HARRY F. MANBECK, JR.

*Attesting Officer*

*Commissioner of Patents and Trademarks*